US011766108B2

(12) United States Patent
Hammonds et al.

(10) Patent No.: US 11,766,108 B2
(45) Date of Patent: Sep. 26, 2023

(54) METHODS AND APPARATUS FOR DISPENSING COSMETICS

(71) Applicant: Powder Presto, Inc., San Diego, CA (US)

(72) Inventors: Danata Hammonds, San Diego, CA (US); Charles Spyksma, Mukilteo, WA (US)

(73) Assignee: Powder Presto, Inc., San Diego, CA (US)

( * ) Notice: Subject to any disclaimer, the term of this patent is extended or adjusted under 35 U.S.C. 154(b) by 390 days.

(21) Appl. No.: 16/814,992

(22) Filed: Mar. 11, 2020

(65) Prior Publication Data

US 2020/0288839 A1 Sep. 17, 2020

Related U.S. Application Data

(60) Provisional application No. 62/816,852, filed on Mar. 11, 2019.

(51) Int. Cl.
*A45D 33/14* (2006.01)
*A45D 33/22* (2006.01)

(52) U.S. Cl.
CPC ..... *A45D 33/14* (2013.01); *A45D 33/22* (2013.01); *A45D 2200/05* (2013.01); *A45D 2200/10* (2013.01)

(58) Field of Classification Search
CPC .... A45D 33/00; A45D 33/003; A45D 33/006; A45D 33/02; A45D 33/025; A45D 33/06; A45D 33/14; A45D 33/16; A45D 33/22; A45D 2200/00; A45D 2200/05; A45D 2200/0053; A45D 40/0068; A45D 40/0075; B07B 1/00; B07B 1/04; B07B 13/04
USPC ..... 222/142.1
See application file for complete search history.

(56) References Cited

U.S. PATENT DOCUMENTS 5,669,400 A * 9/1997 Sheffler ..... A45D 40/0068 132/294
6,053,183 A * 4/2000 Rizzo ..... A45D 33/006 132/307
8,066,019 B2 11/2011 Zhu et al.
8,235,059 B2 * 8/2012 Pires ..... A45D 40/221 132/299
2008/0251096 A1 * 10/2008 Eng ..... A45D 33/025 132/294
2008/0276956 A1 * 11/2008 Cho ..... A45D 33/04 132/294
2019/0037999 A1 * 2/2019 Mecca ..... A45D 33/02

FOREIGN PATENT DOCUMENTS

KR 101158910 * 6/2012

* cited by examiner

*Primary Examiner* — Cris L. Rodriguez
*Assistant Examiner* — Karim Asqiriba
(74) *Attorney, Agent, or Firm* — Wang Hardoon, P.C.

(57) ABSTRACT

A cosmetic container that converts unusable broken pressed powder into loose powder. The cosmetic container pulverizes broken pressed powder into loose powder via a "screw press" mechanism. In one specific implementation, the pulverized loose powder is held in a sealable sifter enclosure; the enclosure can be locked to prevent leakage during travel. In some variants, the portable cosmetic container may further include storage space for an applicator brush, make-up pad, or other assorted cosmetics.

17 Claims, 7 Drawing Sheets

Top View

100A

Side View

100B

Bottom View

100C

Top View

102AA

Side View

102AB

103

Bottom View

102AC

Top View

102BA

Side View

102BB

Bottom View

102BC

Top View

104A

Side View

104B

Bottom View

104C

Top View

106A

Side View

106B

Bottom View

106C

Top View

108A

Side View

108B

Bottom View

108C

METHODS AND APPARATUS FOR DISPENSING COSMETICS

PRIORITY

This application claims the benefit of priority to U.S. Provisional Patent Application Ser. No. 62/816,852 filed Mar. 11, 2019 and entitled "POWDER PRESTO", which is incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNICAL FIELD

This disclosure relates generally to the field of cosmetics containers and/or accessories for handling cosmetic powder.

DESCRIPTION OF RELATED TECHNOLOGY

Face powder is a cosmetic powder applied to the face. It comes in two forms; either as a loose powder or as a pressed powder. Loose powder comes in a container (usually a jar) and has small particles. Pressed powder comes in a compact and contains ingredients used to bind the powder when it is pressed into a friable solid. Both kinds of face powder have the same basic function: to even out skin tone and absorb oil.

SUMMARY

The present disclosure describes, inter alia, methods and apparatus for pulverizing, holding, and dispensing broken compact powder.

A cosmetic dispensing apparatus is disclosed. In one embodiment, the cosmetic dispensing apparatus includes: a pulverizing component comprising a first cavity, a second cavity, and a perforated screen disposed therebetween; a press component configured to pulverize a friable cosmetic solid in the first cavity via the perforated screen, into the second cavity; and a sealable sifter component configured to control access to the pulverized friable cosmetic solid.

In one variant, the pulverizing component and the press component are complementarily threaded to function as a screw press. In one exemplary variant, the screw press is configured to impart compressing and shearing forces on the friable cosmetic solid.

In one variant, the press component comprises a textured press face.

In one variant, the perforated screen is characterized by hole widths of 1.0 millimeters.

In one variant, the sealable sifter component can be opened to permit access to the pulverized friable cosmetic solid and closed to stow the pulverized friable cosmetic solid for portable use. In one such variant, the sealable sifter component includes a sifter plate and a cover plate. In one such variant, the cosmetic dispensing apparatus includes a top lid that locks the sealable sifter component for travel.

In one variant, the cosmetic dispensing apparatus includes a storage space between a bottom lid and the press component.

A cosmetic dispensing apparatus is disclosed. In one embodiment, the cosmetic dispensing apparatus includes: a pulverizing component configured to pulverize a friable cosmetic solid into a loose powder; an enclosure component configured to control access to the loose powder; and a locking component configured to lock the enclosure component.

In one variant, the pulverizing component is configured to reduce the friable cosmetic solid into particles suitable for cosmetic application. In one such variant, the pulverizing component is configured to impart compressing forces on the friable cosmetic solid. In one such variant, the pulverizing component is configured to impart shearing forces on the friable cosmetic solid.

In one variant, the enclosure component comprises a sifter component configured to sift the loose powder for application.

In one variant, the enclosure component comprises a cover component characterized by at least an open position and a closed position. In one variant, the locking component is configured to lock the cover component in the closed position.

In one variant, the cosmetic dispenser additionally includes a storage space component to store a cosmetic applicator.

A method of dispensing friable cosmetic solids is disclosed. In one embodiment, the method includes: pulverizing a friable cosmetic solid into a loose powder within a cosmetic dispensing apparatus; storing the loose powder within a sealable enclosure of the cosmetic dispensing apparatus; opening the sealable enclosure of the cosmetic dispensing apparatus; and applying the loose powder.

In one variant, the pulverizing comprises compressing and shearing the friable cosmetic solid into the loose powder.

In one variant, the method further includes locking the sealable enclosure of the cosmetic dispensing apparatus for travel.

Other features and advantages of the present disclosure will immediately be recognized by persons of ordinary skill in the art with reference to the attached drawings and detailed description of exemplary embodiments as given below.

DETAILED DESCRIPTION

Figure 1:
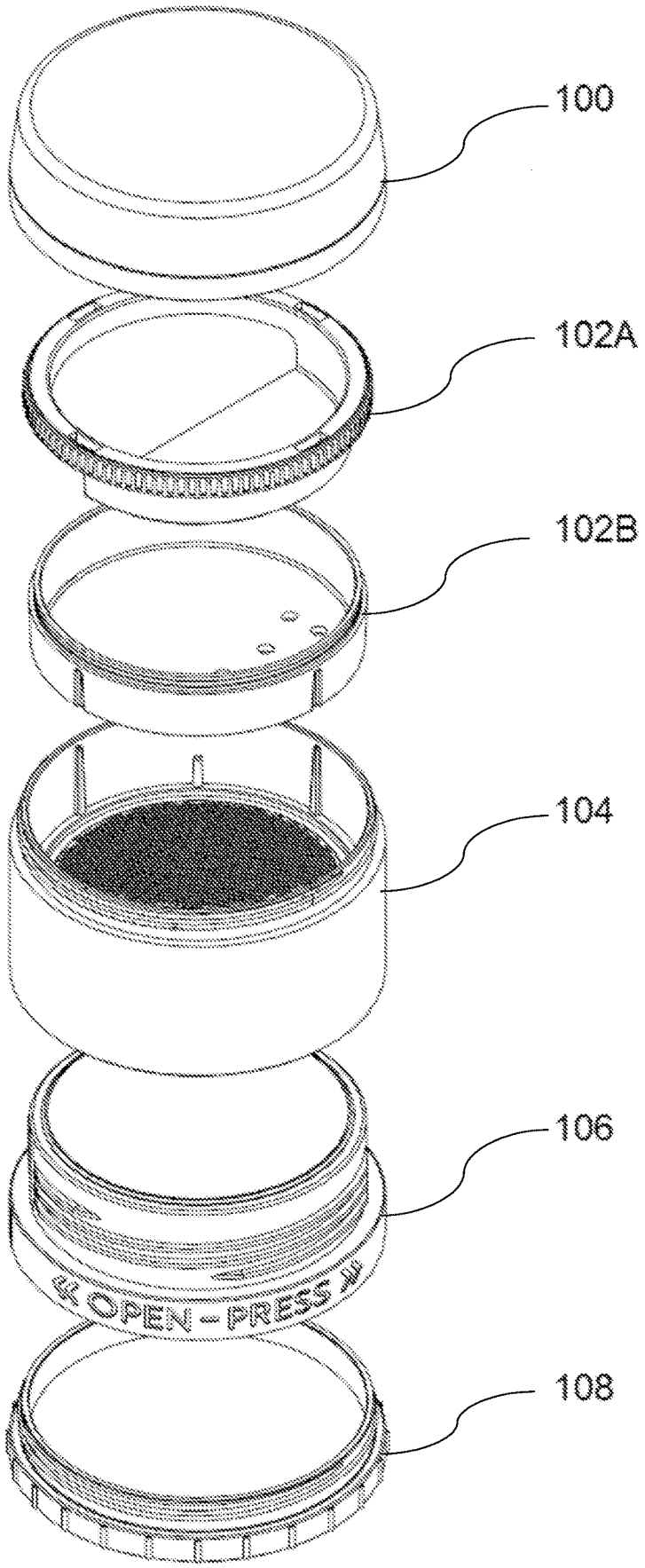
FIG. 1 is a graphical illustration of one exemplary cosmetic container assembly, in accordance with the various principles described herein.

In the following detailed description, reference is made to the accompanying drawings which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without departing from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

Example Operation

Cosmetic powders are used to even out skin tone and absorb oil. Even though pressed powders and loose powders perform the same cosmetic function, they are used differently. Loose powders provide an even and uniform finish when applied over large areas of the face. Unfortunately, loose powder can spill easily and is sold in containers that are not meant for portable use. In contrast, pressed powders are packaged in small compacts that are suitable for travel; pressed powders can also be applied with precision control (for spot touch-ups, etc.)

During pressed powder application, the applicator brush sweeps up a uniform layer of pressed powder which can then be applied to the face. Notably, the pressed powder is designed to easily crumble and adhere to the applicator brush with only very slight pressure. As a practical matter, pressed powder is easily broken, and once broken it may not apply correctly. The cracks and fissures in broken pressed powder may cause the applicator brush to unevenly pick up powder. This can create a "caked on" appearance when applied to the face (visibly thickened application and/or uneven streaks). Additionally, broken powder may no longer stay within the compact; chunks of pressed powder may fall out creating a mess during application or travel. Once broken, most consumers wastefully discard their cosmetic compacts rather than deal with the mess and hassle.

Various embodiments of the present disclosure provide a cosmetic container that converts unusable broken pressed powder into loose powder. In one exemplary embodiment, the cosmetic container pulverizes broken pressed powder into loose powder. In one specific implementation, the pulverized loose powder is held in a sealable sifter enclosure to prevent leakage during travel. The sifter enclosure can be opened to access the pulverized loose powder for cosmetic application. In some variants, the portable cosmetic container may further include storage space for an applicator brush, make-up pad, or other assorted cosmetics.

FIG. 1 is a graphical illustration of one exemplary cosmetic container assembly. As shown therein, the cosmetic container assembly comprises: a top lid 100, a sealable sifter sub-assembly (102A, 102B), a pulverizing component 104, a press component 106, and a bottom lid 108. In the illustrated embodiment, the top lid 100, the pulverizing component 104, press component 106, and bottom lid 108 are fastened together via threaded mating mechanisms. A sealable sifter sub-assembly (102A, 102B) is snap-fit together within the pulverizing component 104. The top lid 100 may include "fingers" (described in greater detail infra) to contact the top surface of the half-moon cover plate 102A.

During the exemplary pulverizing operation, the user inverts the cosmetic container assembly (such that the bottom lid 108 is upward) and unscrews the press component 106 from the cosmetic container assembly to expose a first cavity within the pulverizing component 104 for holding pieces of broken pressed powder. The user places pieces of broken pressed powder into the exposed cavity of the pulverizing component 104 and screws the press component 106 back into the cosmetic container assembly. As the press component 106 is screwed into the cosmetic container, it forces the broken pieces of pressed powder through a perforated screen into a second cavity of the pulverizing component 104. Notably, the rotational motion of the press component 106 provides compressing and shearing pressure on the broken pressed powder, which pulverizes the pressed powder pieces against the perforated screen into fine loose powder.

Once the broken pieces of pressed powder have been completely pressed through the perforated screen, the resulting loose powder is securely trapped in the second cavity of the pulverizing component 104. The sealable sifter sub-assembly (102A, 102B) comprises two (2) plates (a "sifter plate" 102B and a "half-moon cover plate" 102A) that can be rotatably opened or closed to permit access to the loose powder for facial application. In some variants, the sealable sifter sub-assembly (102A, 102B) can be entirely removed to provide unencumbered access to all of the loose powder (e.g., transfer to another container, cleaning, etc.)

In order to apply the loose powder, the user removes the top lid 100 (while in the non-inverted position) from the cosmetic container assembly. The sealable sifter sub-assembly (102A, 102B) is rotated to its "open" position (where the sifting holes of the sifter plate are not covered by the half-moon cover plate), and the user lightly shakes the cosmetic container to allow a controlled amount of powder out onto the sifter sub-assembly for use. After application, the user can push the remaining loose powder back into the second cavity of the pulverizing component 104 and rotate the sealable sifter sub-assembly (102A, 102B) into the "closed" position (where the sifting holes of the sifter plate are covered by the half-moon cover plate).

In one specific implementation, the top lid 100 provides a locking fit against the sealable sifter sub-assembly (102A, 102B). The locking fit ensures that the sealable sifter sub-assembly (102A, 102B) does not accidentally slide into the "open" position during travel. Additionally, cosmetic applicators may be stowed under the bottom lid 108.

Generalized Apparatus and Methods of Use

Figure 2:
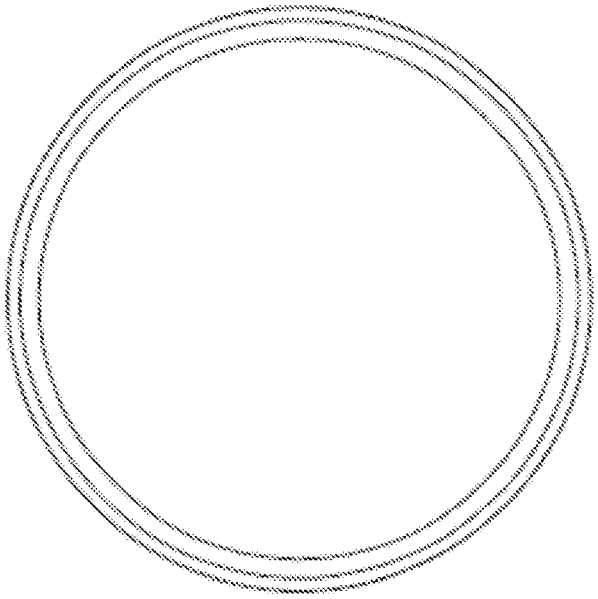
FIG. 2 is a graphical illustration of the top view, side view, and bottom view of the top lid of the exemplary cosmetic container assembly, in accordance with the various principles described herein.
Figure 2:
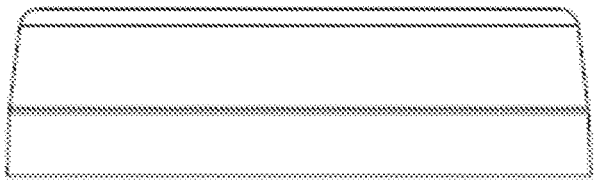
Figure 2:
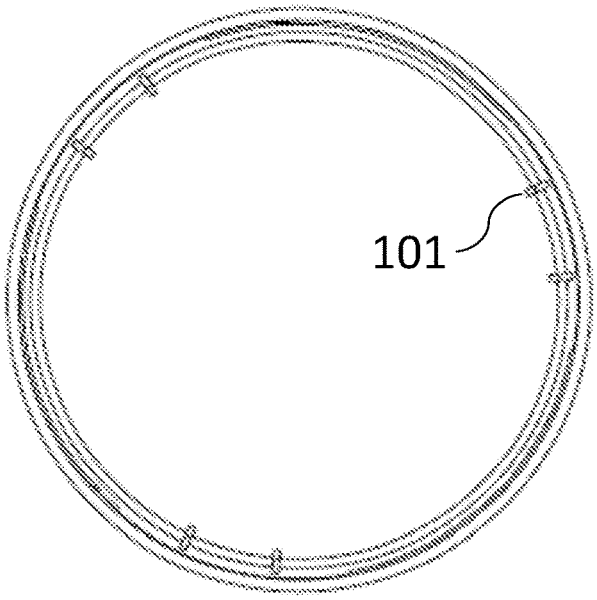

FIG. 2 provides a top view 100A, side view 100B, and bottom view 100C of the top lid of the cosmetic container assembly. In one exemplary variant, the top lid may include a locking mechanism 101 to lock the sealable sifter sub-assembly into place during travel or portable use. Specifically, a set of fingers 101 located on the underside of the tapered top lid contact the sifter and provide enough friction to prevent the sifter from inadvertently opening. In some variants, the fingers 101 may lock into grooves 103 (depicted in FIG. 3, infra) of the sealable sifter sub-assembly to provide additional rigidity. The locking mechanism prevents the sealable sifter sub-assembly from inadvertently opening while the top lid 100 is affixed.

While the illustrated implementation uses a relatively unobtrusive locking design to fasten the lid to the cosmetic container body, other implementations may substitute any number of other lid sealing and/or locking mechanisms. For instance, other variants may use a friction fastening, threaded fastening, magnetic fastening, spring fit fastening, gasket seal, and/or other fastening mechanism.

Figure 3:
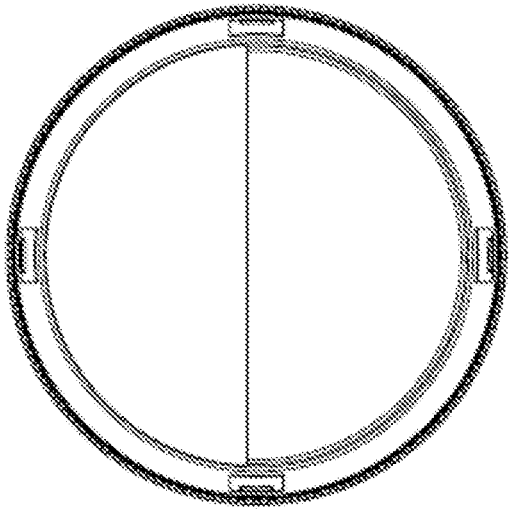
FIG. 3 is a graphical illustration of the top view, side view, and bottom view of the half-moon cover plate of the sealable sifter sub-assembly, in accordance with the various principles described herein.
Figure 3:
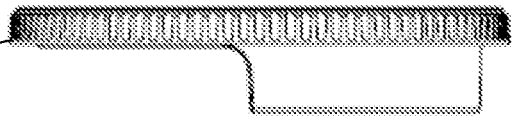
Figure 3:
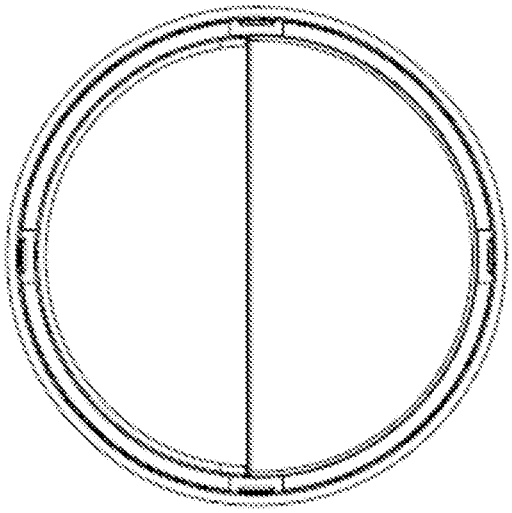
Figure 4:
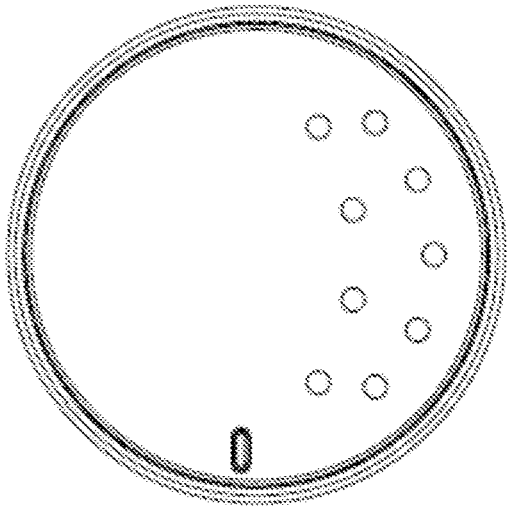
FIG. 4 is a graphical illustration of the top view, side view, and bottom view of the sifter plate of the sealable sifter sub-assembly, in accordance with the various principles described herein.
Figure 4:
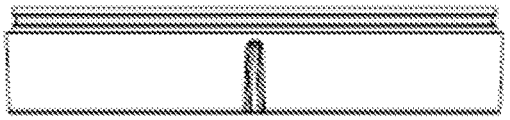
Figure 4:
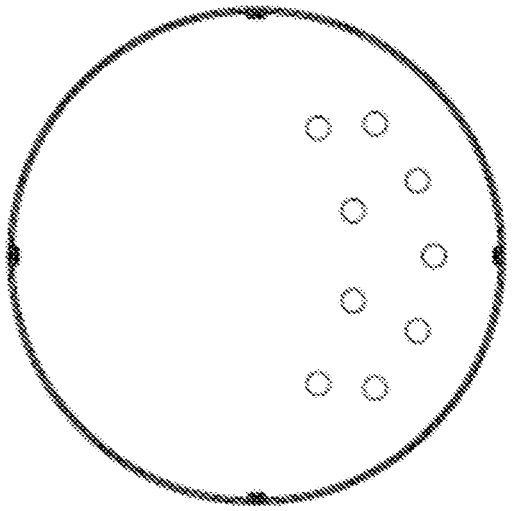

FIG. 3 provides a top view 102AA, side view 102AB, and bottom view 102AC of the half-moon cover plate of the sealable sifter sub-assembly. The half-moon cover plate has an "open" portion (a large half-moon opening), and a "closed" portion (a plastic shield). FIG. 4 provides a top view 102BA, side view 102BB, and bottom view 102BC of the sifter plate of the sealable sifter sub-assembly. The sifter plate has a sifter portion (with sifting holes), and a closed portion (without sifting holes). The sifter plate may additionally include an upraised stop.

In one exemplary embodiment, the half-moon cover plate of the sealable sifter sub-assembly is snap-fit into the sifter plate of the sealable sifter sub-assembly; the half-moon cover plate can freely rotate into an "open" position which uncovers the sifting holes, or a "closed" position which covers the sifting holes. The upraised stop limits rotation of the half-moon cover plate (e.g., to prevent over-rotation). The sealable sifter sub-assembly can be opened to provide controlled access to the loose powder for application and closed to securely stow the loose powder for travel. While the foregoing design nests the half-moon cover plate within the sifter plate, other designs may be switched (e.g., the sifter plate may nest in a cover plate, etc.)

More generally, artisans of ordinary skill in the related arts given the contents of the present disclosure may substitute other enclosure mechanisms with equal success. Some variants may use sliding-window enclosures, slide-out enclosures, or other hybrid enclosure mechanisms. Additionally, while the foregoing implementation is described in the context of an "open" and a "closed" position, other variants may use partial openings. For example, a sealable sifter sub-assembly design may have an open position, half-open position, a closed position, etc. Such variations may be useful to control the amount of loose powder that is sifted. Still other designs may vary sifting holes in size and shape. As but one example, some sifting holes may be larger or smaller to change the amount of loose powder; other examples may use patterned or non-circular openings for aesthetic considerations and/or logos, etc.

Figure 5:
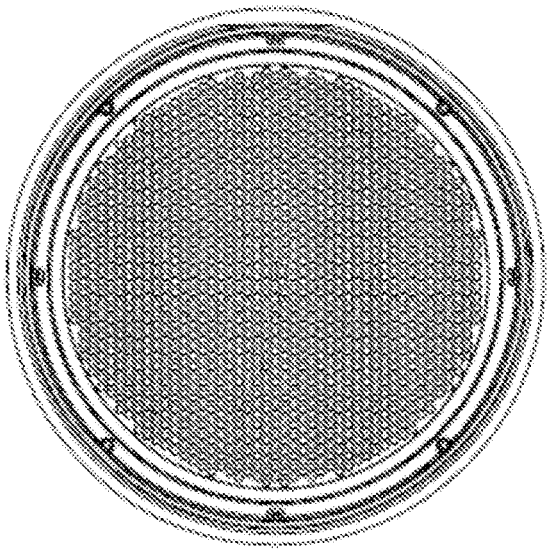
FIG. 5 is a graphical illustration of the top view, side view, and bottom view of the pulverizing component of the exemplary cosmetic container assembly, in accordance with the various principles described herein.
Figure 5:
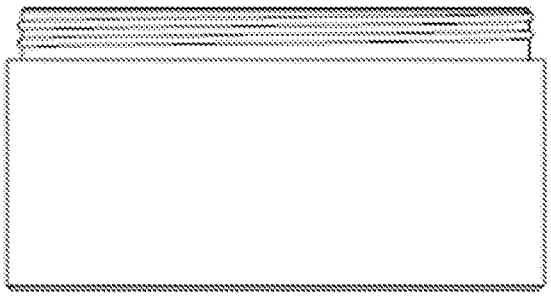
Figure 5:
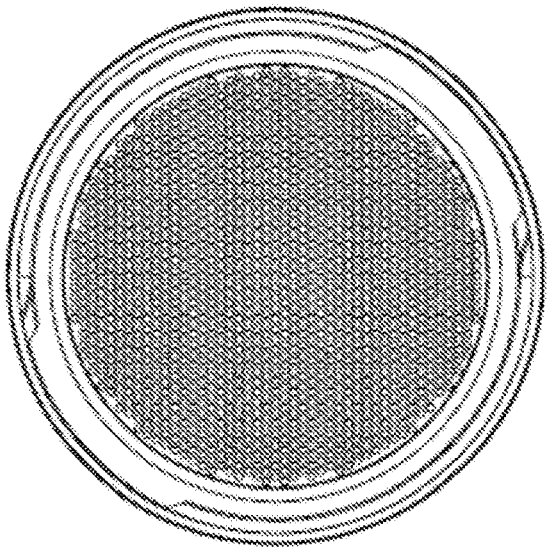
Figure 6:
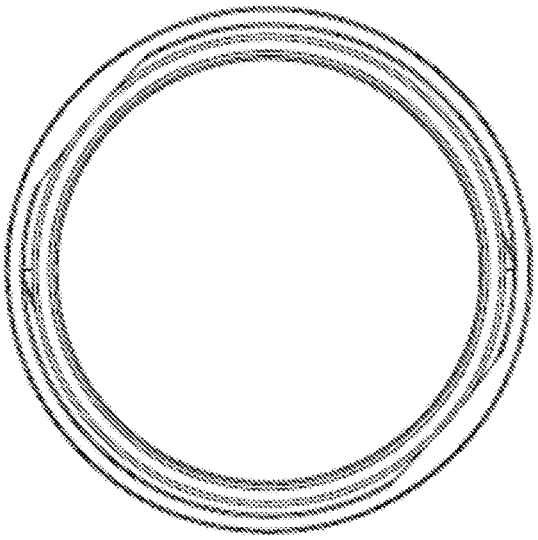
FIG. 6 is a graphical illustration of the top view, side view, and bottom view of the press component of the exemplary cosmetic container assembly, in accordance with the various principles described herein.
Figure 6:
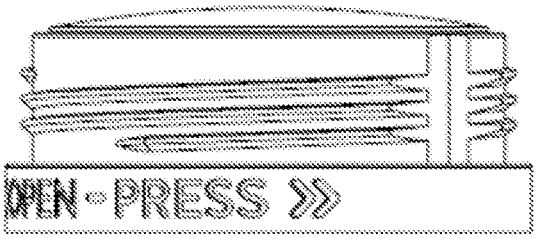
Figure 6:
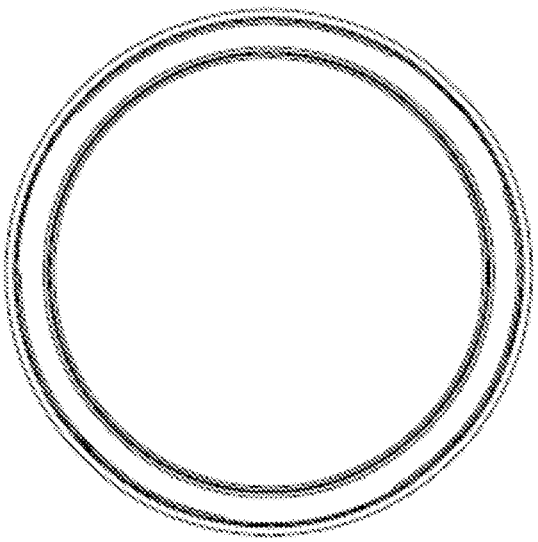

FIG. 5 provides a top view 104A, side view 104B, and bottom view 104C of the pulverizing component 104. The pulverizing component 104 includes a perforated screen disposed within, the perforated screen divides the pulverizing component 104 into two (2) cavities (one to hold the broken pressed powder, and one to hold the pulverized loose powder). FIG. 6 provides a top view 106A, side view 106B, and bottom view 106C of the press component 106. The pulverizing component 104 and press component 106 are complementarily threaded, and function as a screw press. The exemplary screw press structure applies both shear and compression forces when pulverizing the broken pressed powder.

Referring first to the pulverizing component 104, the illustrated press component includes a perforated screen. In one exemplary embodiment, the perforated screen is a metal plate that is sufficiently rigid to withstand the pressure required to pulverize the pressed powder. Due to the friable nature of pressed powder (e.g., facial powder crumbles under applicator brush pressure), relatively light weight metal and/or other materials may be substituted with equal success. Common examples of metals that may be used may include without limitation: stainless steel, aluminum, tin, brass, titanium, copper, nickel, chrome, silver, gold, platinum, and/or other metallurgical compounds or plated versions thereof. Common examples of plastics may include polyvinyl chloride (PVC), polyethylene and derivatives thereof (PET, HDPE, LDPE), polystyrene (PS), and/or other polymer materials. Other materials which may be used may include e.g., ceramic materials, glasses, and/or woods. In some embodiments, the pulverizing component 104 may use a wire mesh, grid, interlaced material, and/or other structure suitable for breaking apart friable cosmetic powders.

As used herein, the terms "pulverize", "pulverizes", "pulverized", "pulverizing" refer to any technique or process that reduces a friable cosmetic solid into particles suitable for cosmetic application. Due to the wide variation in cosmetic product manufacture, different perforated screen sizes may result in different cosmetic application. Larger holes result in less uniform loose powder, whereas smaller holes may be clogged with clumps of loose powder. Empirically, a hole width of 1.0 millimeters (mm) provided a reasonable balance of visually even application (i.e., no "caking"), without clogging, for a variety of different cosmetic brands. Other hole sizes (e.g., 0.5 mm, 2.0 mm) may be substituted with equal success by artisans of ordinary skill in the related arts, given the contents of the present disclosure.

In some embodiments of the pulverizing component 104, the perforated screen may be removable and/or interchangeable. A removeable perforated screen may be particularly useful to assist in cleaning out clogged holes, etc. Similarly, interchangeable perforated screens may enable the user to select the particular perforated screen that optimally works for their desired cosmetic product. For example, certain cosmetic applications may do better when more thickly (or thinly) applied. Similarly, the different consistencies of pressed powder products may more (or less) easily clog the screen.

As previously noted, the broken pressed powder is pushed and rotated through the perforated screen to impart both compression and shear forces. Artisans of ordinary skill in the related arts given the contents of the present disclosure may substitute other pulverizing mechanisms with equal success. Other embodiments may use only compression forces (e.g., crushing, beating, etc.) or only shearing forces (e.g., sliding, grinding, etc.) to pulverize the broken pressed powder into loose powder. For example, the broken pressed powder may be pulverized by being tumbled and shaken with a mixer object (e.g., a freely moving weight). In other examples, the broken pressed powder may be crushed between two or more grinding plates.

As used herein, the terms "compressing", and "compression" refer to the application of aligned forces on a body; in contrast, the terms "shearing", and "shear" refer to the application of unaligned force on a body (resulting in a "twisting" motion).

Referring now to the press component 106, the press component includes a press face (the portion that presses the pressed powder through the screen) and screw press threads. In one exemplary embodiment, the press face has a textured surface to aid in pulverizing the powder through the perforated screen. In other embodiments, the press face may be a smooth surface to minimize the loss of powder. Still other embodiments may use a surface that complementarily nestles within the perforated screen to prevent clogging, or even a "brush" surface that clears and/or cleans the perforated screen when completely screwed in.

The exemplary embodiment utilizes screw threads that are sized and manufactured of a material of sufficient strength to withstand the rotational force required to pulverize the pressed powder, however other implementations may be substituted with equal success. For example, the broken pressed powder may be directly pushed through the pulverizing component 104 with a straight press, a spring-loaded press, or similar mechanism. In some cases, the broken pressed powder may be pushed through the pulverizing component using fingers or brush pressure.

Figure 7:
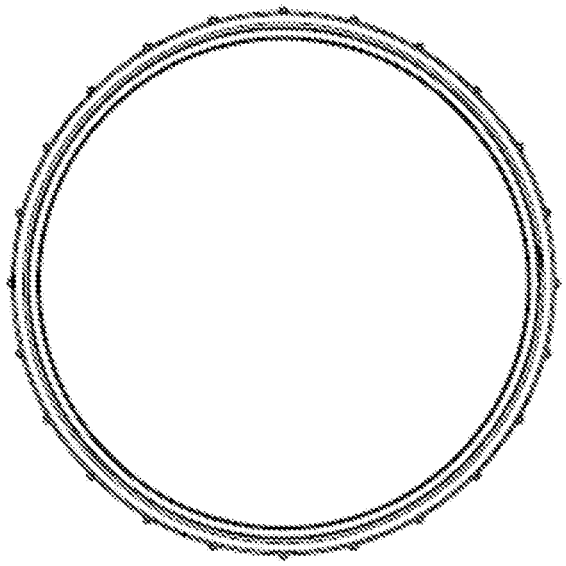
FIG. 7 is a graphical illustration of the top view, side view, and bottom view of the bottom lid of the exemplary cosmetic container assembly, in accordance with the various principles described herein.
Figure 7:
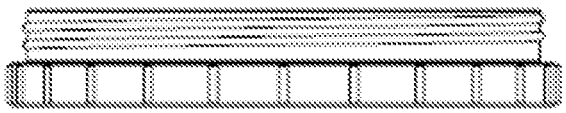
Figure 7:
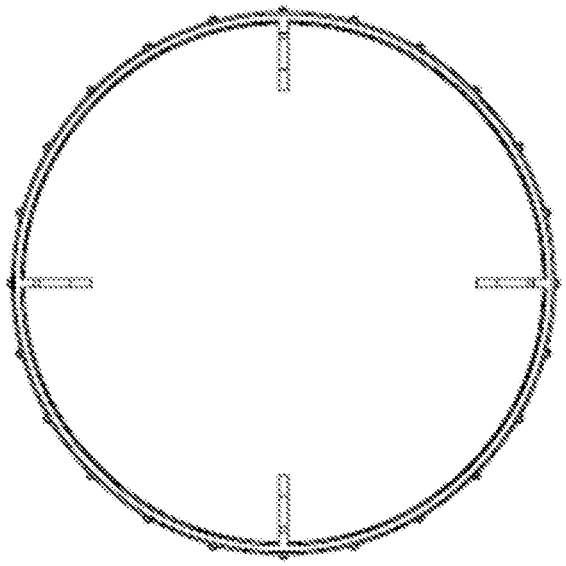

FIG. 7 provides a top view 108A, side view 108B, and bottom view 108C of the bottom lid of the cosmetic container assembly. In one exemplary embodiment, the bottom lid of the cosmetic container assembly mates to the bottom of the press component 106. The storage space created between the bottom lid 108 and the press component 106 can be used to store small applicators (brushes, make-up pads) and/or other assorted small cosmetics (lip stick, lip gloss, etc.)

In one exemplary embodiment, the top lid 100, sealable sifter sub-assembly (102A, 102B), press component 106, and bottom lid 108 of the cosmetic container are made from plastic. Notably however, cosmetic containers are commonly designed to appeal to a variety of different market niches and aesthetic styles; thus, artisans of ordinary skill in the related arts will readily appreciate that the foregoing components (as described in FIGS. 1-7, supra) may be manufactured from a variety of materials including without limitation: plastic, metal, wood, glass, ceramics, and/or any hybrid combination thereof.

While the foregoing discussion is presented in the context of loose and pressed face powder, artisans of ordinary skill in the related arts will readily appreciate that the principles described herein may find use with a variety of other cosmetics. Examples of such cosmetics may include e.g., eyeshadow, rouge/blush, foundation, contour/highlighting powder, bronzer, setting powder, eyebrow powder and/or any other friable solid cosmetic. As used herein, the term "friable" refers to any solid which may be crumbled into smaller fragments with light pressure (exerted via e.g., brush bristle, hand pressure, etc.)

Additionally, while the foregoing disclosure enables the economical re-use of otherwise unusable broken pressed powder, other applications for the cosmetic container may be substituted with equal success. For example, the exemplary cosmetic container may be used to combine two or more different cosmetic powders. This may be desired to e.g., match a particular skin tone, achieve an unusual color combination and/or texture, etc.

It will be apparent to those skilled in the art that various modifications and variations can be made in the disclosed embodiments of the disclosed device and associated methods without departing from the spirit or scope of the disclosure. Thus, it is intended that the present disclosure covers the modifications and variations of the embodiments disclosed above provided that the modifications and variations come within the scope of any claims and their equivalents.

What is claimed is:

1. A cosmetic dispensing apparatus, comprising:

a pulverizing component comprising a first threaded mating mechanism, a first cavity, a second cavity, and a perforated screen between the first cavity and the second cavity, where the first threaded mating mechanism has an inner diameter that is greater than an outer diameter of the perforated screen;

a press component comprising a press face and a second threaded mating mechanism, where the first threaded mating mechanism is complementarily threaded to the second threaded mating mechanism and where the press component is configured to screw into the first cavity to pulverize a friable cosmetic solid in the first cavity through the perforated screen, into a pulverized friable cosmetic solid in the second cavity; and a sealable sifter component configured to control access to the pulverized friable cosmetic solid.

2. The cosmetic dispensing apparatus of claim 1, wherein the pulverizing component and the press component are complementarily threaded to function as a screw press.

3. The cosmetic dispensing apparatus of claim 2, wherein the screw press is configured to impart compressing and shearing forces on the friable cosmetic solid.

4. The cosmetic dispensing apparatus of claim 1, wherein the press component comprises a textured press face.

5. The cosmetic dispensing apparatus of claim 1, wherein the perforated screen is characterized by hole widths of 1.0 millimeters.

6. The cosmetic dispensing apparatus of claim 1, wherein the sealable sifter component can be opened to permit access to the pulverized friable cosmetic solid; and wherein the sealable sifter component can be closed to stow the pulverized friable cosmetic solid for portable use.

7. The cosmetic dispensing apparatus of claim 6, wherein the sealable sifter component comprises a sifter plate and a cover plate.

8. The cosmetic dispensing apparatus of claim 6, further comprising a top lid that locks the sealable sifter component for travel.

9. The cosmetic dispensing apparatus of claim 1, further comprising a storage space between a bottom lid and the press component.

10. A cosmetic dispensing apparatus, comprising:

a pulverizing component comprising a perforated screen;

a press component comprising a convex press face configured to screw into the pulverizing component and compress broken cosmetic solids through the perforated screen into an enclosure component as a loose powder;

where the enclosure component is configured to control access to the loose powder; and a locking component configured to lock the enclosure component.

11. The cosmetic dispensing apparatus of claim 10, wherein the pulverizing component is configured to reduce the broken cosmetic solids into the loose powder that is suitable for cosmetic application.

12. The cosmetic dispensing apparatus of claim 11, wherein the press component is configured to impart compressing forces on the broken cosmetic solids.

13. The cosmetic dispensing apparatus of claim 11, wherein the press component is configured to impart shearing forces on the broken cosmetic solids.

14. The cosmetic dispensing apparatus of claim 10, wherein the enclosure component comprises a sifter component configured to sift the loose powder for application.

15. The cosmetic dispensing apparatus of claim 10, wherein the enclosure component comprises a cover component characterized by at least an open position and a closed position.

16. The cosmetic dispensing apparatus of claim 15, wherein the locking component is configured to lock the cover component in the closed position.

17. The cosmetic dispensing apparatus of claim 10, further comprising a storage space component to store a cosmetic applicator.

* * * * *